US005492064A

United States Patent [19]

Boutet

[11] Patent Number: 5,492,064

[45] Date of Patent: Feb. 20, 1996

[54] PROPELLANT GAS SEALING DEVICE FOR GUN MUNITIONS

[75] Inventor: Claude Boutet, Bourges, France

[73] Assignee: Giat Industries, Versailles, France

[21] Appl. No.: 325,317

[22] PCT Filed: Mar. 8, 1994

[86] PCT No.: PCT/FR94/00254

§ 371 Date: Dec. 9, 1994

§ 102(e) Date: Dec. 9, 1994

[87] PCT Pub. No.: WO94/21981

PCT Pub. Date: Sep. 29, 1994

[30] Foreign Application Priority Data

Mar. 18, 1993 [FR] France ..... 93 03096

[51] Int. Cl.[6] ..... F42B 14/00

[52] U.S. Cl. ..... 102/520; 102/439; 102/524; 102/532

[58] Field of Search ..... 102/520–527, 102/532, 431–433, 439, 443, 700

[56] References Cited

U.S. PATENT DOCUMENTS

| | | | |
|---|---|---|---|
| H403 | 1/1988 | Glasser | 102/520 |
| 648,243 | 4/1900 | Dawson et al. | 102/526 |
| 868,938 | 10/1907 | Puff | 102/524 |
| 3,216,356 | 11/1965 | Kaufmann, Jr. . | |
| 4,043,269 | 8/1977 | Ambrosini | 102/523 |
| 4,384,529 | 5/1983 | Burns et al. . | |
| 4,549,488 | 10/1985 | Hoffmann et al. | 102/522 |
| 4,800,816 | 1/1989 | Meyer | 102/523 |
| 5,014,624 | 5/1991 | Baxter et al. | 102/523 |

FOREIGN PATENT DOCUMENTS

| | | | |
|---|---|---|---|
| 373960 | 5/1907 | France | 102/520 |
| 380063 | 9/1907 | France . | |
| 2635178 | 2/1990 | France . | |
| 2672672 | 8/1992 | France . | |
| 25850 | 11/1912 | United Kingdom | 102/520 |

*Primary Examiner*—Harold J. Tudor
*Attorney, Agent, or Firm*—Oliff & Berridge

[57] ABSTRACT

A propellant gas sealing device for gun munitions includes a piston attached to the rear of a projectile by a separable connecting device, and a piston that isolates the projectile from the propellant charge. A low pressure seal carried by the piston is designed to ensure the gastightness between the piston and the gun chamber, and a high pressure obturator carried by the piston is designed to ensure the gastightness between the piston and the gun barrel.

8 Claims, 2 Drawing Sheets

PROPELLANT GAS SEALING DEVICE FOR GUN MUNITIONS

BACKGROUND OF THE INVENTION

The scope of the present invention is that of munitions designed to be fired from artillery guns, and more specifically, those which are fired by means of a propellant charge which may or may not be separated from the actual projectile.

Presently, there is a tendency nowadays to increase gun calibers (i.e., the diameter of the barrel), and more particularly those of tank guns. Higher initial projectile speeds may thereby be obtained.

However, the diameter of the chamber is generally not increased in the same proportions so as to restrict the overall diameter of the weapon.

Weapon designers therefore find themselves forced to increase the length of the chamber in order to maintain an expansion ratio (total volume barrel+chamber/volume chamber) which enables the desired speed performances to be reached.

In such a context the problem of the overall size of the munitions arises. This problem is often solved by dividing the load into two load elements (one carrying the projectile and possibly some powder, and another of powder alone).

However, if it is possible, with such a division of the munition, to design projectile munitions of the arrowhead type (sub-caliber shafts, fin-stabilized) wherein the length of the load remains limited, it is not possible to define munitions with explosive projectiles without being forced to:

- either lengthen the projectile carrying load,

- or reinforce the mechanical resistance of the projectile, thereby reducing its stability and effectiveness.

In fact, the arrowhead shafts are able to penetrate to a relative depth into the powder without any problems of mechanical resistance.

The envelope of explosive munitions can not penetrate the explosive charge without it becoming essential to increase its thickness, which leads to a decrease in its stability and a reduction in the internal volume devoted to the explosive charge, thereby reducing its effectiveness.

The obturator which ensures gastightness must therefore be situated to the rear of the envelope of the explosive projectile, forcing the projectile carrying load to be lengthened.

SUMMARY OF THE INVENTION

One object aim of the invention is to produce a munition to be fired from an increased caliber gun, a munition which must be neither too long nor have a projectile envelope which is too thick.

The invention is therefore likely to be applicable to all cases where a projectile is to be fired wherein the rear part must not be subject, at least at first, to the pressure generated by the propellant gases. In other terms:

- a projectile with a thin envelope, such as a missile or cargo,

- a projectile carrying a propellant charge which must be initiated later in the barrel or during the trajectory.

With this end in view, the invention may be applied both to a two-load munition and a single-load cased munition.

One object of the invention is to solve the basic problem wherein a projectile sensitive to gas pressure may be fired from a gun without necessarily having its structure reinforced.

To fulfil the above objective the invention concerns a device comprising:

- a piston integral with the projectile which insulates the projectile from the main propellant charge,

- sealing structure positioned around the piston and fitted with a seal which ensures low pressure gastightness between the piston and the weapon chamber and an obturator ensuring high pressure gastightness between the piston and the barrel.

Such structure therefore enable explosive munitions to be defined wherein the overall axial size is relatively reduced as the projectile may be entirely lodged inside the chamber.

This structure also enable munitions which are sensitive to gas pressure such as missiles to be fired from a tank gun. These are isolated from an ejector propellant charge by means of a piston according to the invention.

Delay initiating structure will permit initiation of the propellant charge integrated in the missile after leaving the gun barrel.

Lastly this structure enables munitions carrying a propellant charge on-board ("Travelling Charge" concept), a charge which is integral with the projectile and which is initiated only when it is in the barrel.

In this event, the piston will separate the main charge from the travelling charge. Delay priming structure enables the charge integral with the projectile to be primed at a given moment inside the barrel (this known concept enables the speed to be increased while restricting the pressure).

BRIEF DESCRIPTION OF THE DRAWINGS

A wide range of other characteristics can be drawn from the description made hereafter in reference to the annexed drawings which illustrate, as a non-limitative example, one particular embodiment of the invention.

DETAILED DESCRIPTION OF PREFERRED EMBODIMENTS

Figure 1:
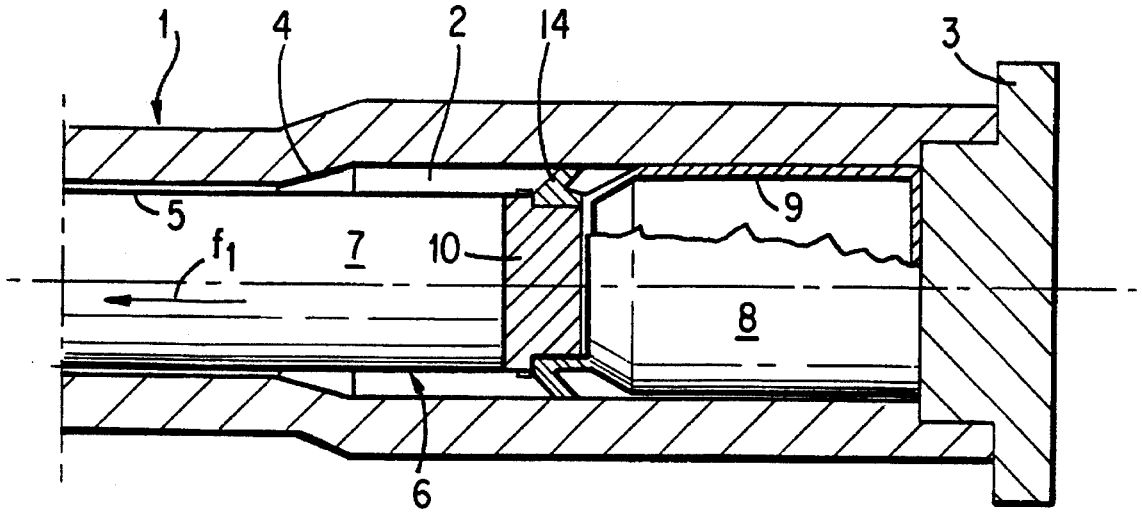
FIG. 1 is a skeleton view of a projectile fitted with the device according to the invention.

FIG. 1 shows a skeleton view of the barrel 1 of a gun wherein the rear part demarcates a loading chamber 2 which may be closed or opened by a mobile breech 3.

The chamber 2 is connected to the bore 5 or the barrel 1 by means of a forcing cone 4, in a way defining the caliber of the barrel wherein a munition 6 must be installed by insertion in the chamber 2.

Figure 2:
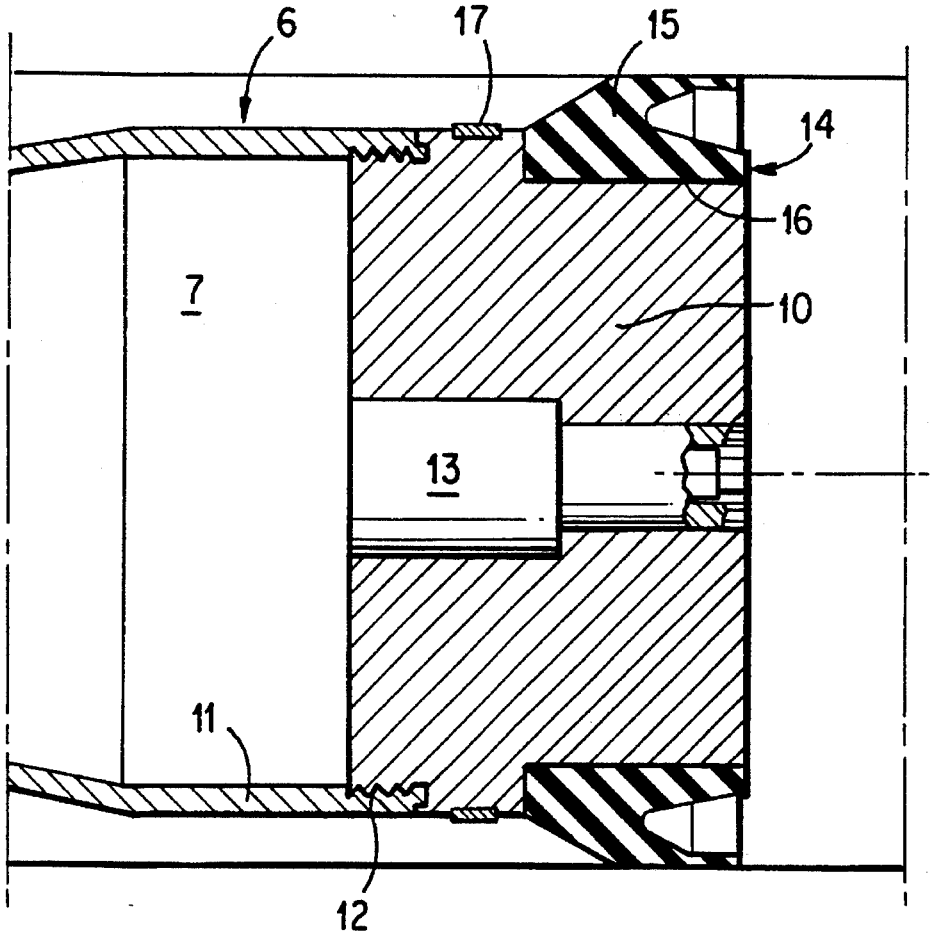
FIG. 2 is a top view showing, on a larger scale, a detail of the construction of the device.

According to FIG. 1, the munition 6 comprises a front load 7 which may be composed of an actual projectile or of an envelope 11 (FIG. 2) in which the projectile is placed.

The munition also comprises a rear load 8 mainly composed of a propellant charge, confined in a casing 9 which may or may not be combustible.

The sealing device according to the invention is composed of a piston 10 made of any suitable material able to withstand the thermal and mechanical stresses generated by the firing of the charge 8. For instance, the piston 10 is made from a light alloy, for example aluminium alloy or carbon fiber with or without metal inserts.

Figure 4:
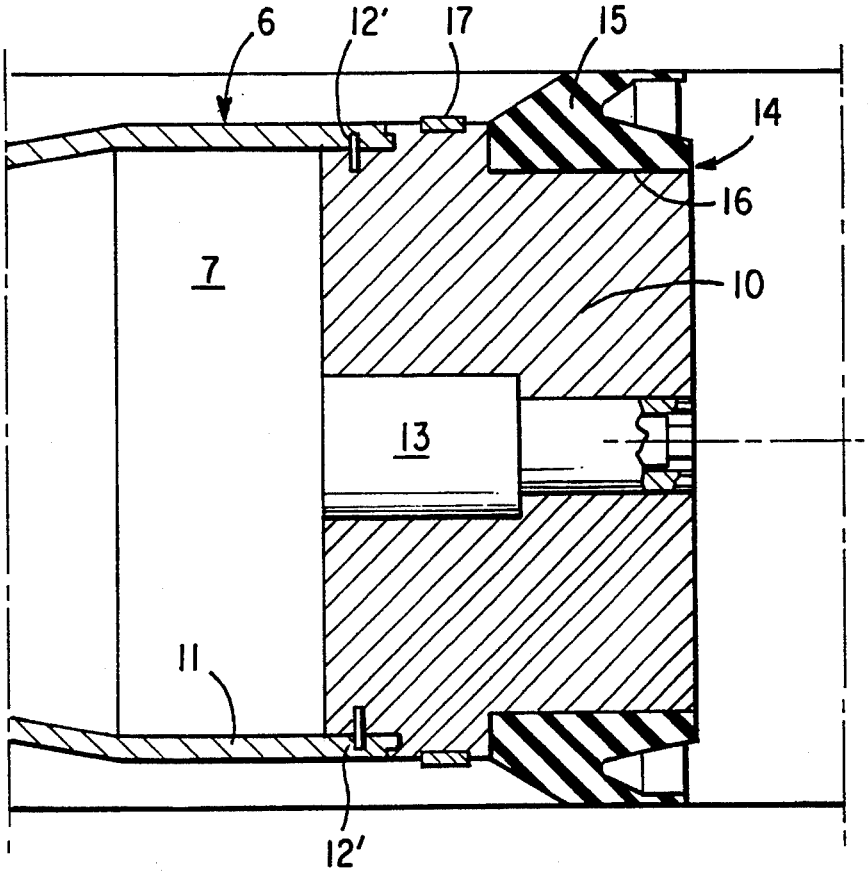
FIG. 4 is a top view showing an enlarged view of an alternative construction of the device.

The piston 10 is either fitted to the rear part of the load 7, or directly to the envelope 11 by means of a separable connecting device 12 or 12'. The separable connecting device 12 or 12' is, for example, constituted of pins 12'(FIG. 4) (or threading 12 (FIG. 2)) which shears off under the force of the propellant gases or of the acceleration. This connecting device 12 shears off at the moment of firing, enabling the piston 10 to separate from the envelope 11 under the force of the aerodynamic pressure to which the projectile is subjected upon exiting from the gun barrel.

The device 12 may advantageously be commanded rather than automatic in which case, it may be advantageous to build a trigger 13 into the piston which is sensitive to pressure and/or heat and is set to delay the neutralisation function of the separable connecting device 12. The trigger 13 is of a known type and, for example, of that described in the French patent no 2,635,278.

The trigger 13 may, naturally, also be used to assume another function such as the delayed ignition of a charge carried inside the load 7.

The piston 10 is provided with low pressure seal 14 on its rear part which presents, in its inoperative state, a cross section greater than the diameter of the chamber 2 so that the engaging of the projectile 6 establishes a surface cooperation by the deformation of the seal thereby able to establish a gastight contact.

The seal 14 will preferably be made in such as way as to comprise at least one peripheral lip 15 capable of elastic deformation and chosen in a material such that its own reaction to the elastic deformation keeps it in permanent peripheral contact with the sides of the chamber 2.

The seal 14 may be of a simple type made for example of polyethylene or possibly of a complex type including one of several elastic inserts enabling the lip 15 to be brought to bear upon the chamber 2. The seal 14 preferably comprises at least one over-calibrated lip by for example 5 to 10% over the diameter of the chamber 2. Such a lip may for example have an axial contact length in the region of 10 to 20 mm for a chamber diameter of 170 mm.

The seal 14 is fitted in a housing 16 in the rear part of the piston 10 and is held in place by means of sticking or duplicate molding.

The seal 14 is designed to be able to be strained in a centripetal radial direction so as to occupy, under maximum stress, a section conforming to the passage of the forcing cone 4 and to the bore caliber 5. In this objective, the seal may be made to shear during the passage of the forcing cone 4.

The sealing device is also provided in the front part of the piston 10 by means of a sealing band or belt 17 constituting a high pressure obturator, set to cooperate through constraint with the bore 5.

In the position illustrated in FIG. 1 the firing of the charge 8 supplies a certain quantity of pressurized gas which is confined in the chamber 2 by means of the seal 14. At this stage, the gas pressure to which the seal 14 is subjected is a low pressure in the region of 200 MPa. Thus, the rear part of the projectile 6 and more particularly the load 7, despite being placed partly within the chamber 2, are guided within the chamber 2, without the surplus annular volume being directly concerned by the active confinement of the firing charge.

The generated energy is therefore confined within a defined volume and acts on the usable end surface of the piston 10 in order to propel the load 7 within the bore 5.

The progression of the load 7 in the direction of the arrow f1 brings the ring 17 to cooperate with the forcing cone 4 in which it is constrained in order to establish a high pressure gastightness between the load 7 and the bore 5. This high pressure gastightness takes over from the seal 14 before the seal has come into contact with the forcing cone 4 in such a way that the combustion gases generated are effectively confined in the variable volume expansion chamber, defined between the breech 3 and the rear face of the piston 10 inside the chamber 2.

In practice, the piston 10 is-fitted as described hereabove to the rear part of the load 7 or the envelope 11, and may comprise suitable means to ensure its connection with the load, in such a way as to facilitate handling operations and the loading of the projectile 6 in the form of a single unit. Such means may, for example, consist in interlockable prongs or, alternatively, fasteners made of additional stick-on elements of the type known under the trade name "VELCRO" which are described in this application in French Patent 2,672,692.

Figure 3:
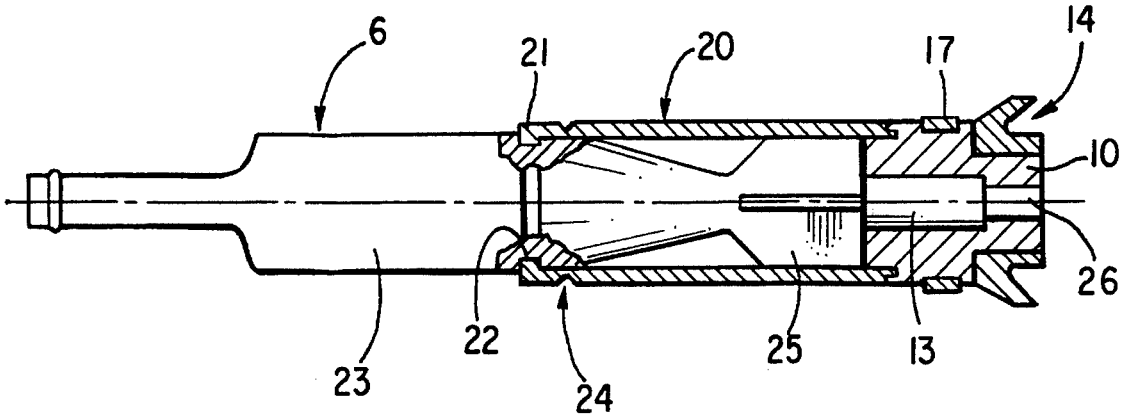
FIG. 3 is a top view illustrating, on a smaller scale, a specimen of applications.

FIG. 3 shows an embodiment wherein the piston 10 is fitted at the end of a case 20 for example of plastic material which is fastened by a rim or by internal hooks 21 onto a peripheral groove 22 provided on the body 23 of the fin-stabilized type projectile 6. The case 20 may thus be compared to the envelope 11.

The case 20, which is roughly to the same caliber as the gun 1, is provided with a fracture starting point 24, for example ring-shaped and situated behind the rim of the hooks 21.

The case 20 thereby envelopes the rear part of the munition or projectile which may be of the explosive type and comprise a stabilizing fin 25 protected by the case 20 and the piston 10.

The piston 10 therein carries a pyrotechnic composition 13 which is delay initiated by the ignition of the charge 8, for example by means of a delay device 26. In this way, the gas pressure caused by the ignition of the composition 13 causes the projectile to separate from the case to the right of the fracture starting point 24 upon exiting from the gun 1.

In the written example, the seal 14 is placed to the rear of the piston and the obturator 17. An inversion of this position may be envisaged wherein the seal 14 is placed to the front of the obturator 17 which thereafter receives the gas pressure as soon as the explosive charge has been ignited.

The invention is not limited to the example described and represented as a wide range of modifications may be brought to bear within the scope of the invention.

I claim:

1. A propellant gas sealing device for gun munitions having a projectile and a propellant charge, said sealing device comprising:

a piston separably attached to a rear of a projectile, said piston serving to isolate the projectile from a propellant charge;

a low pressure seal mounted on the piston to ensure an airtight fit between the piston and a gun chamber; and a high pressure obturator connected to the piston to ensure an airtight fit between the piston and a gun barrel.

2. A device according to claim 1, wherein the low pressure seal is disposed to a rear of the piston and behind the high pressure obturator.

3. A device according to claim 1, wherein the piston carries a separable connecting device selected from the group consisting of a delay, an automatic separating device and a command operated separating device.

4. A device according to claim 1, wherein the piston carries a pressure-sensitive trigger set to delay separation of the projectile from the piston.

5. A device according to claim 4, wherein piston carries the means to operate a delayed ignition of a supplementary propellant charge integral with the projectile.

6. A device according to claim 1, wherein the low pressure seal has at least one flexible lip and a diameter of the lip greater than a diameter of a loading chamber before the flexible lip is loaded into the loading chamber.

7. A device according to claim 1, wherein the piston is separably attached to the rear of the projectile with a separable connecting device selected from the group consisting of pins and threads.

8. A device according to claim 1, further comprising means for separable attaching the piston to a rear of the projectile, said means for separably attaching including a case member having a circumferential fracture joint, said circumferential fracture joint being located adjacent said rear of the projectile.

* * * * *